US006116319A

United States Patent [19]

Simon

[11] Patent Number: 6,116,319

[45] Date of Patent: Sep. 12, 2000

[54] DEVICE FOR CONNECTING THE FLEXIBLE CURTAIN OF A DOOR AND ITS HAULING STRAPS

[76] Inventor: Bernard Simon, 20 Chem. J.B. Gailliard, 69300 Caluire, France

[21] Appl. No.: 09/071,861

[22] Filed: May 4, 1998

[30] Foreign Application Priority Data

May 5, 1997 [FR] France ..... 97/05788

[51] Int. Cl.[7] ..... A47H 5/00

[52] U.S. Cl. ..... 160/84.01; 160/264

[58] Field of Search ..... 160/84.01, 84.06, 160/264, 84.04

[56] References Cited

U.S. PATENT DOCUMENTS

| | | | |
|---|---|---|---|
| 4,397,347 | 8/1983 | Brabant | 160/84.01 X |
| 4,610,290 | 9/1986 | Dörflinger | 160/84 R |
| 4,712,598 | 12/1987 | Bonacci et al. | 160/84.06 |
| 5,207,256 | 5/1993 | Kraeutler | 160/264 X |

FOREIGN PATENT DOCUMENTS

| | | |
|---|---|---|
| 0501881 | 9/1992 | European Pat. Off. . |
| 2410117 | 6/1979 | France . |
| 2683587 | 5/1993 | France . |
| 2732065 | 9/1996 | France . |
| 3305300 | 8/1884 | Germany . |

*Primary Examiner*—David M. Purol
*Attorney, Agent, or Firm*—Greenblum & Bernstein, P.L.C.

[57] ABSTRACT

A device for connecting the flexible curtain of a door and its hauling straps having a mechanism connected to a proximately located horizontal reinforcing bar and with a retention mechanism such as a ring for the retaining the hauling strap. The distance between the horizontal reinforcing bar and the ring varies in association with the location of the bar on the curtain.

5 Claims, 4 Drawing Sheets

DEVICE FOR CONNECTING THE FLEXIBLE CURTAIN OF A DOOR AND ITS HAULING STRAPS

BACKGROUND OF THE INVENTION

The present invention relates to a connecting device for retaining the hauling straps relative to the horizontal reinforcing bars of a handling door of the raisable type, comprising a flexible curtain which can be concertina-folded.

This kind of door generally comprises a metal structure made up of a drive shaft and of several horizontal reinforcing bars which are housed, via sheaths, within the thickness of the flexible curtain.

The horizontal reinforcing bars slide in vertical slideways, the separation of which is somewhat greater than the thickness of the curtain. Provided at the lower part of the door and parallel to the horizontal reinforcing bars is a hauling bar which is connected to the drive shaft via hauling straps which can be wound onto said drive shaft.

Some horizontal reinforcing bars bear connecting devices which are runners or rings through which the hauling straps freely pass in order to allow the flexible curtain to be raised uniformly.

These connecting devices or strap runners consist of a cylindrical sleeve made of plastic secured to a closed flange constituting a free space for the passage of the hauling strap to be retained.

Housings or openings are cut in the thickness of the curtain to allow the strap runners to be fitted to the horizontal reinforcing bars.

The strap runners are identical as regarding their configuration irrespective of the number of horizontal reinforcing bars. The same strap runner can be found on the horizontal reinforcing bar at the bottom of the curtain or on the horizontal reinforcing bar at the top of the curtain.

Thus, the hauling strap, when the door is being opened, lifts the hauling bar which, as it rises, comes into contact with the horizontal reinforcing bar just above it in order to carry it along vertically, and so on as far as the horizontal reinforcing bar at the top of the curtain.

As the door is raised, the strips of curtain which are situated between two horizontal reinforcing bars fold and pile up on top of one another to form a concertina of material.

Inserted between the horizontal reinforcing bars are horizontal tubes or deflection tubes which are free relative to the hauling strap. The function of the deflection tubes is to form and to maintain the fold in the curtain between two contiguous horizontal reinforcing bars as the door opens.

When the flexible curtain moves vertically, it can be seen that the strap runners knock together, considerably increasing the operating noise of the handling door. The deflection tubes at the bottoms of the folds constitute a rigid sill which may present collision risks to people passing through the door while it is moving.

Some doors make it possible to eliminate the deflection tubes by fitting articulated stays which are fixed to the horizontal reinforcing bars.

These solutions are costly and have the drawback of damaging the curtain where the arm of the stay rests against it.

SUMMARY OF THE INVENTION

It is these drawbacks that the present invention sets out to overcome.

The connecting device according to the present invention comprises flexible means which interact with the corresponding horizontal reinforcing bar and with a ring or the like for retaining the hauling strap. The distance of said flexible means between the horizontal reinforcing bar and the ring or the like varies as a function of the location of said bar on the curtain.

The connecting device in accordance with the invention comprises flexible means which consist of a tie provided at one of its ends with a first loop receiving the corresponding horizontal reinforcing bar and at the other end with a second loop secured to a ring or the like for the retaining and the passage of the hauling strap. The distance between the first loop and the second varies as a function of the location of the horizontal reinforcing bar on the curtain.

The present invention also relates to a handling door comprising a flexible curtain which is concertina-folded, said curtain being equipped in its thickness with several horizontal reinforcing bars and with a hauling bar which is connected to the drive shaft via hauling straps, such that said door comprises connecting devices each of which is provided with flexible means which interact with the corresponding horizontal reinforcing bar and with a ring or the like for the retaining and the passage of the hauling strap. The distance of said flexible means between the horizontal reinforcing bar and the ring or the like varies as a function of the location of said bar on the curtain.

The door according to the present invention comprises connecting devices each equipped with flexible means which consist of a tie provided at one of its ends with a first loop receiving the corresponding horizontal reinforcing bar and at the other end with a second loop secured to a ring or the like for the retaining and the passage of the hauling strap. The distance between the first loop and the second varies as a function of the location of the horizontal reinforcing bar on the curtain.

BRIEF DESCRIPTION OF THE DRAWINGS

The description which will follow, with reference to the appended drawings which are given by way of nonlimiting example, will make it possible better to understand the invention, the features it presents and the advantages it is likely to afford.

DETAILED DESCRIPTION OF THE INVENTION

Figure 1:
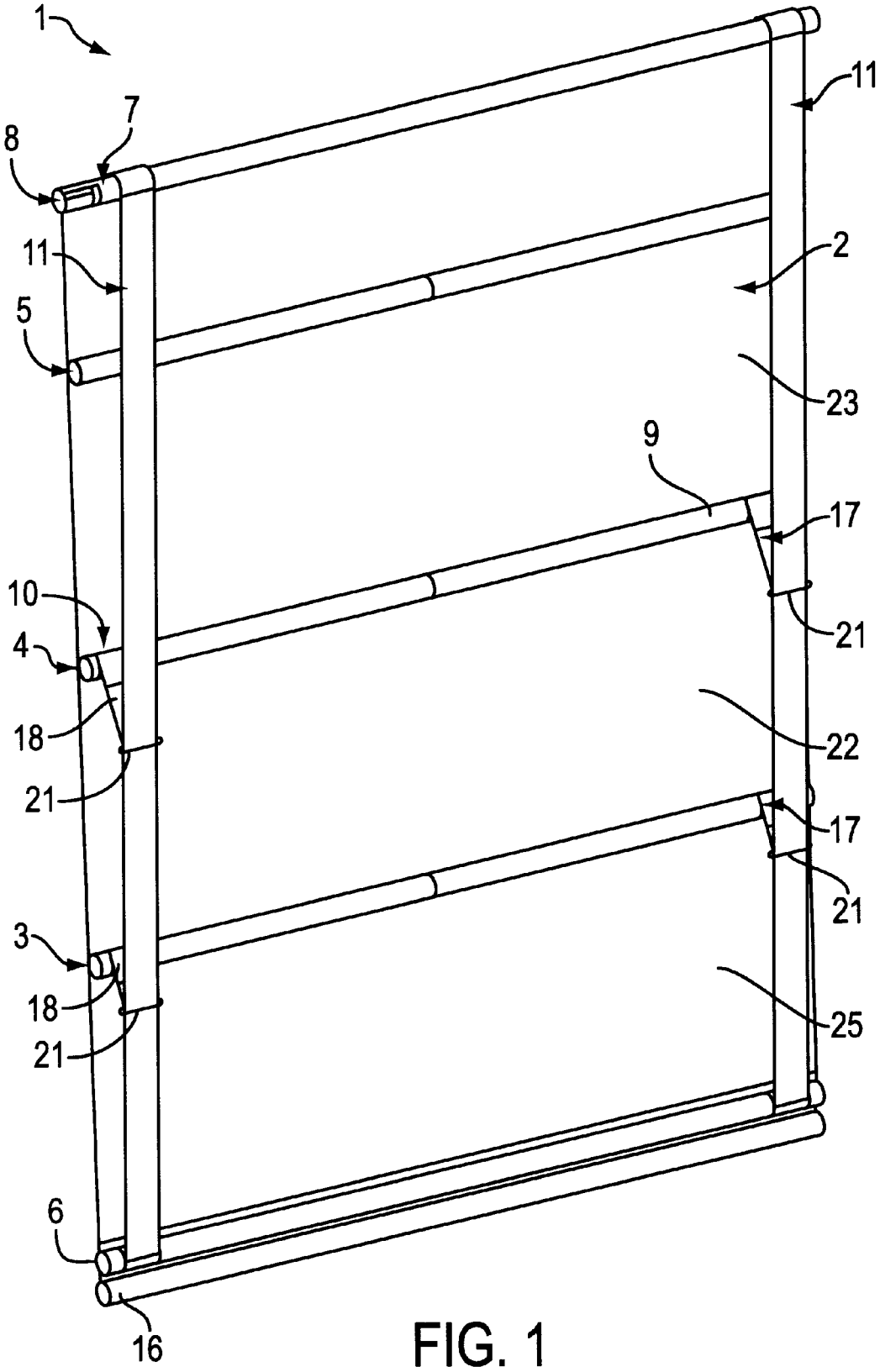
FIG. 1 is a perspective view showing a handling door in the closed position, provided with the connecting device according to the present invention.
Figure 2:
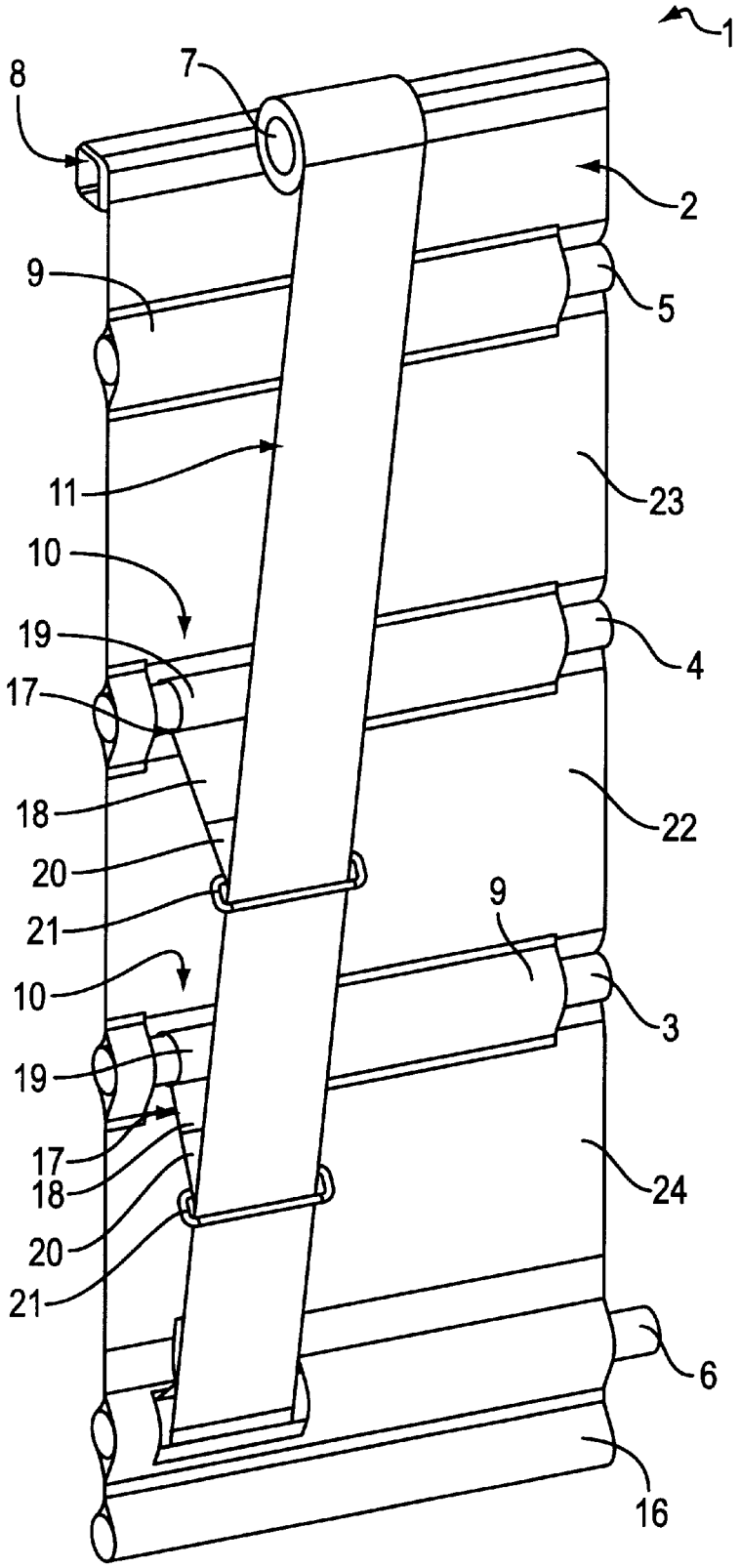
FIG. 2 is a part section illustrating a handling door in the closed position, provided with the connecting device according to the invention.
Figure 3:
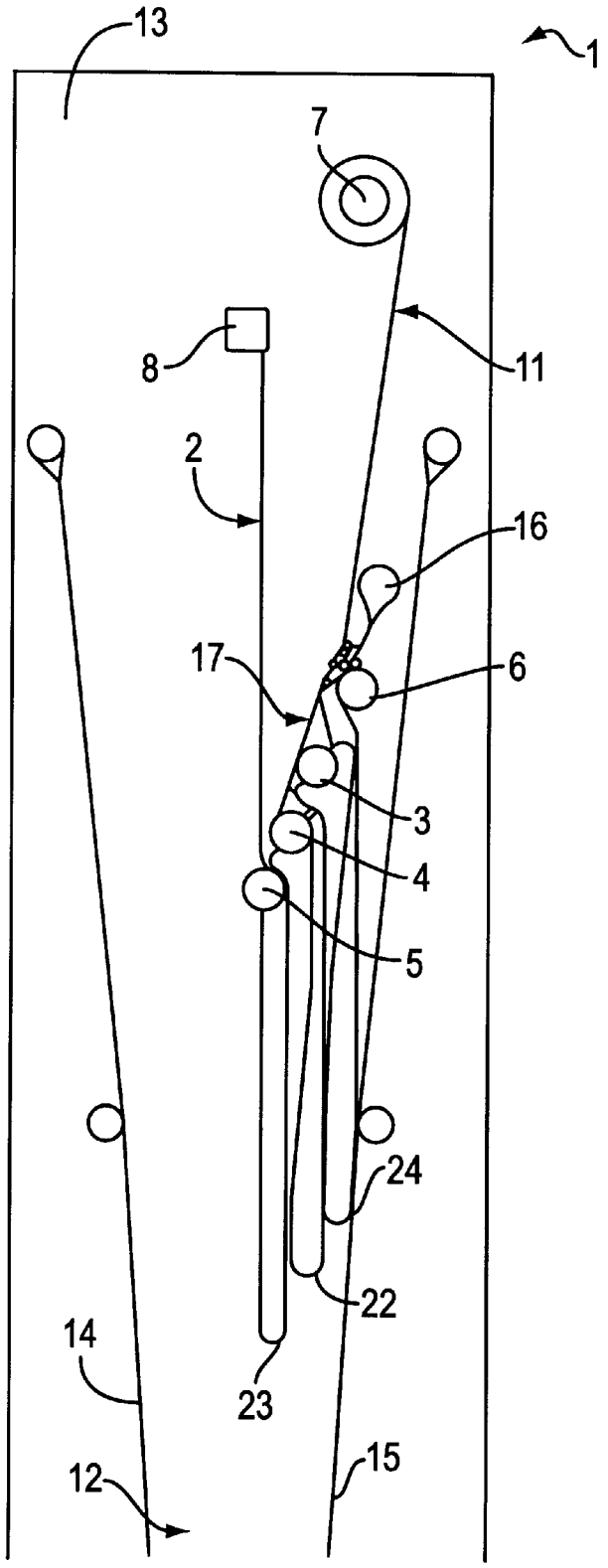
FIG. 3 is a part section depicting the handling door according to the present invention in the open position with the curtain concertina-folded.
Figure 4:
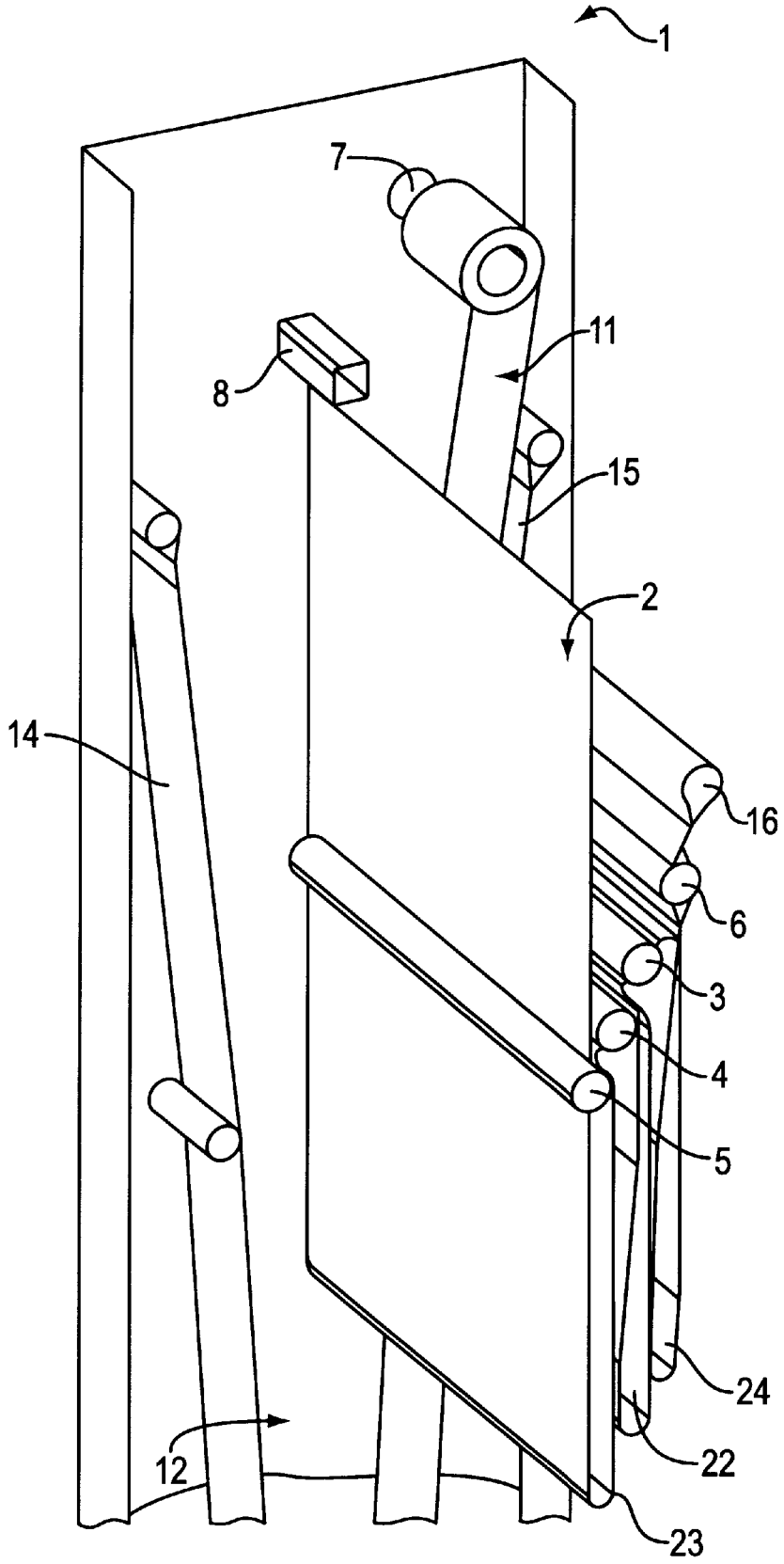
FIG. 4 is a diagrammatic view showing the position of the horizontal reinforcing and hauling bars when the handling door according to the present invention is in the open position.

Depicted in FIGS. 1 to 4 is a handling door 1 which comprises a flexible curtain 2 in which horizontal reinforcing bars 3, 4, 5 and a hauling bar 6 which allows the curtain to be raised are kept parallel to one another.

The door 1 comprises a drive shaft 7 rotated by a geared motor unit, not depicted, for moving the flexible curtain 2 from a closed position to an open position.

Provided close to the drive shaft 7 is a stationary support bar 8 of square section about which the upper free end of the flexible curtain 2 is fixed.

The horizontal reinforcing bars 3, 4, 5 and the hauling bar 6 are housed in sheaths 9 provided within the thickness of the flexible curtain 2.

The sheaths 9 receiving the horizontal reinforcing bars 3, 4 and the hauling bar 6 comprise cut-outs 10 for the passage of hauling straps 11.

The horizontal reinforcing bar 5 at the top of the flexible curtain 2 is introduced into a sheath 9 which may or may not have cut-outs 10.

The horizontal reinforcing bars 3, 4, 5 and the hauling bar 6 slide in flexible slideways 12 secured to the vertical uprights 13 of the frame. The flexible slideways 12 consist of straps 14 and 15 as already described and protected in a patent application in the name of the applicant.

The vertical movements of the door 1 are achieved via the hauling straps 11 which are secured to the drive shaft 7 and fixed to the hauling bar 6.

The hauling straps 11 are fixed to the hauling bar 6 in such a way that there is no play between each of the straps 11 and said bar as the flexible curtain 2 moves vertically.

It may be noted that the flexible curtain 2 below the sheath 9 receiving the hauling bar 6 has a flexible sill 16 in the form of a loop.

In addition, between each horizontal reinforcing bar 3 and 4, 4 and 5 and between the bar 3 and the hauling bar 6, the flexible curtain 2 has strips 22, 23, 24 respectively.

The hauling straps 11 are held laterally relative to each horizontal reinforcing bar 3, 4, 5 between the drive shaft 7 and the hauling bar 6 by a connecting device or strap runner 17.

The connecting devices 17 are fixed around each horizontal reinforcing bar 3, 4 at cut-outs 10 made in the sheaths 9 of the flexible curtain 2.

Each connecting device 17 comprises flexible means which consist of a tie 18 provided at one of its ends with a first loop 19 and at the other end with a second loop 20 which interacts with a ring 21 of rectangular or similar shape.

The first loop 19 of the connecting device 17 is designed to receive the corresponding horizontal reinforcing bar 3, 4.

When the connecting device 17 is fitted to each horizontal reinforcing bar 3, 4, the ring 21 allows the retaining and the passage of the corresponding hauling strap 11.

The first loop 19 of the connecting device or strap runner 17 is sewn with a diameter somewhat equivalent to that of the horizontal reinforcing bars 3, 4.

The distance of the flexible means of the connecting device 17 and more specifically between the first loop and the second varies as a function of the location of the horizontal reinforcing bar 3, 4 on the flexible curtain 2.

In effect, the shortest distance of the connecting device 17 between the two loops 19 and 20 is on the horizontal reinforcing bar 3 which is at the bottom of the flexible curtain 2, while the longest distance between the two loops is on the horizontal reinforcing bar 4 highest up the flexible curtain 2.

As the door 1 is opened, the hauling straps 11 lifts the hauling bar 6 which as it rises comes into contact with the ring 21 fixed into the second loop 20 of each connecting device or strap runner 17 provided on the horizontal reinforcing bar 3.

The tie 18 of each connecting device 17, placed on the horizontal reinforcing bar 3, becomes taut as the hauling straps 11 are wound around the drive shaft 7 to haul said horizontal reinforcing bar. The length of the tie 18 of each connecting device 17 placed on the horizontal reinforcing bar 3 is sufficient to allow said bar 3 to be suspended under the hauling bar 6.

The hauling bar 6 and the horizontal reinforcing bar 3 as they rise come into contact with the rings 11 of each connecting device 17 which are fixed to the second horizontal reinforcing bar 4 in such a way that the tie 18 of said connecting devices 17 become taut in order to allow the second bar 4 to move.

The length of the ties 18 of each connecting device 17 placed on the horizontal reinforcing bar 4 is sufficient to allow said bar 4 to be suspended under the bar 3 which is itself suspended under the hauling bar 6.

This configuration repeats itself for each horizontal reinforcing bar on the flexible curtain 2 of the door 1. Note that the length of the ties 18 of the connecting devices 17 placed on each horizontal reinforcing bar 3, 4 differ.

The method of raising the horizontal reinforcing bars 3, 4 to the advantage that, for each bar, it maintains a free space making the forming of the strips 22, 23, 24 easier, and in particular avoiding the fabric becoming trapped between two bars as the strip is folding.

Thus, each fold of the successive strips 24, 22, 23 is formed correctly without the aid of a deflection tube or any other means as described earlier.

Note that the stacking in the flexible curtain 2 is the opposite of what is commonly effected with handling doors that have strap runners of identical length for each horizontal reinforcing bar.

The connecting device 17 according to the present invention makes it possible to eliminate the deflection tubes used on handling doors of the prior art, considerably reducing the cost of manufacturing the door 1.

Also, the flexible curtain 2 is simplified in its construction because the sheaths needed for positioning the deflection tubes are eliminated.

Furthermore, the use of the connecting devices 17 according to the invention considerably lowers the operating noises of the door 1, because the horizontal reinforcing bars 3, 4, 5 and the hauling bar no longer come into contact with one another.

The number of horizontal reinforcing bars varies depending on the height of the door 1. The bar 5 may, depending on the operation of the door 1, comprise connecting devices 17 for the retaining and the passage of the hauling straps 11.

Note that the device according to the invention makes it possible, in any position of the door 1 between open and closed, to maintain a flexible sill consisting of folds of strips 22, 23, 24 of a height such that an impact of a moving load or person with this sill will not have serious consequences.

What is claimed is:

1. A connector mechanism for a door comprising:

a flexible curtain comprising a flexible material and horizontal reinforcing bars;

a hauling bar connected to a drive shaft by hauling straps;

said flexible curtain having said horizontal reinforcing bars with a retention mechanism for retaining and connecting to said hauling straps; and a distance between said horizontal reinforcing bar and said retention mechanism varies in association with the location of said bar on said curtain.

2. A connector mechanism for a door according to claim 1 comprising:

said flexible material comprises a tie at one end of said flexible material with a first loop for receiving a corresponding horizontal reinforcing bar;

a second loop at an opposite end of said flexible material secured to said retention mechanism for retaining and connecting to said hauling strap;

said retention mechanism allowing passage of said hauling strap; and a distance between said first loop and said second loop varies in association with the location of said horizontal reinforcing bar on said flexible curtain.

3. A connector mechanism for a door according to claim 1 wherein said retention mechanism comprises a ring.

4. A door comprising:

a flexible curtain that is concertina-folded;

said curtain comprising several horizontal reinforcing bars with a hauling bar connected to a drive shaft by hauling straps;

a retention mechanisms connected to a proximately located horizontal reinforcing bar for retaining and connecting to said hauling straps;

said retention mechanism allowing passage of said hauling straps; and a distance between said horizontal reinforcing bar and said retention mechanism varies in association with the location of said bar on said curtain.

5. A door according to claim 4 comprising:

said flexible curtain comprises a flexible material, a tie at one end of said flexible material with a first loop for receiving one of said horizontal reinforcing bars;

a second loop at the opposite end of said flexible material secured to said retention mechanism for retaining and connecting to said hauling straps;

said retention mechanism allowing passage of said hauling straps; and a distance between said first loop and said second loop varies in association with the location of said horizontal reinforcing bar on said flexible curtain.

* * * * *